United States Patent [19]

Simonds

[11] 4,291,822

[45] Sep. 29, 1981

[54] GUITAR STRAP

[76] Inventor: Lawrence Simonds, c/o Simtron Industries Incorporated, 139 E. Merrick Rd., Freeport, N.Y. 11520

[21] Appl. No.: 155,605

[22] Filed: Jun. 2, 1980

[51] Int. Cl.[3] ..... G10D 3/00; G10G 5/00

[52] U.S. Cl. ..... 224/257; 24/265 AL; 84/327; 224/271; 224/910

[58] Field of Search ..... 224/257, 258, 271, 910; 84/280 R, 327; 24/265 R, 265 A, 265 AL, 265 CD

[56] References Cited

U.S. PATENT DOCUMENTS

| | | | |
|---|---|---|---|
| 2,116,618 | 5/1938 | Crockett | 24/265 CD |
| 3,882,576 | 5/1975 | Kanno | 24/265 R |
| 3,894,464 | 7/1975 | Brooks | 224/910 |
| 3,935,782 | 2/1976 | O'Brien | 84/327 X |
| 4,014,240 | 3/1977 | Pullen | 224/910 |
| 4,028,981 | 6/1977 | Cravens | 84/327 |
| 4,144,794 | 3/1979 | Silverman et al. | 224/257 X |
| 4,181,359 | 1/1980 | Ward | 24/265 AL |

*Primary Examiner*—Stephen Marcus
*Attorney, Agent, or Firm*—Bauer & Amer

[57] ABSTRACT

A guitar support strap attached in swiveling relation about a rotation axis held firmly and in perpendicular relation to the guitar body wall, despite the relative thinness and weak construction material of the wall. In a preferred form, a wood screw threadably engaged to the guitar body wall serves as the rotation axis and is held against movement as might tend to allow the screw to work loose or inadvertently disengage from the wall by a steadying force applied in encircling relation about the wood screw.

3 Claims, 12 Drawing Figures

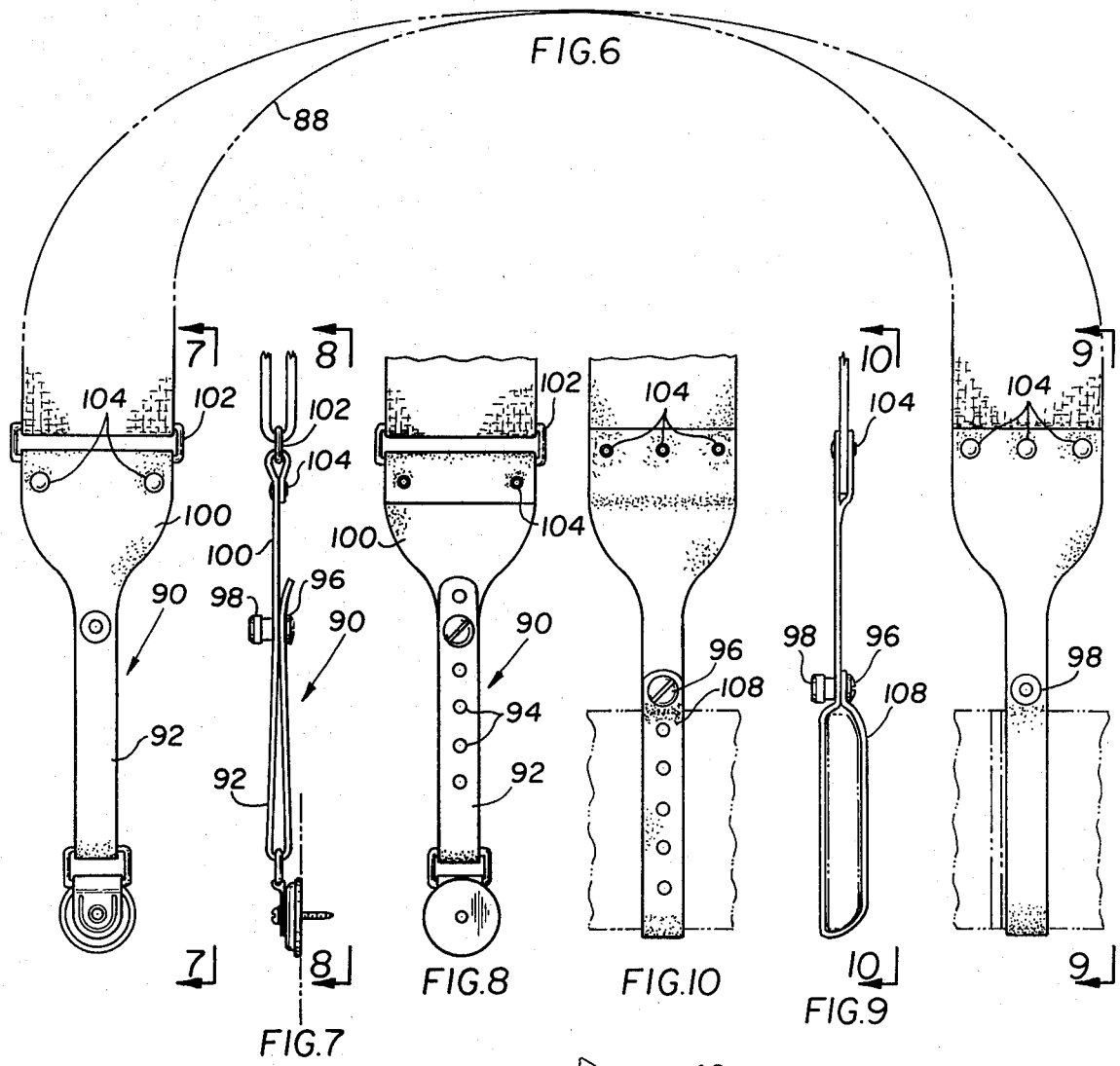
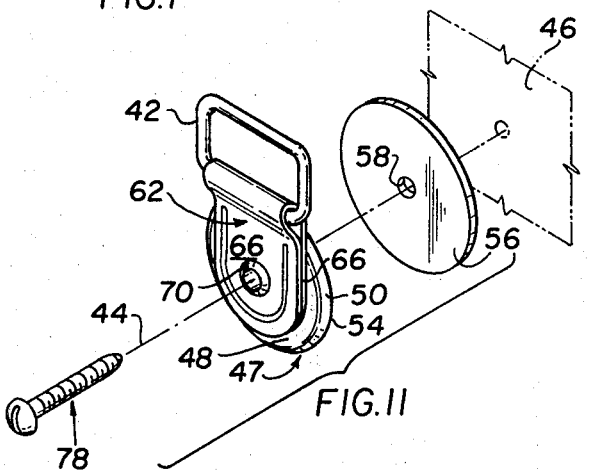
FIG.11
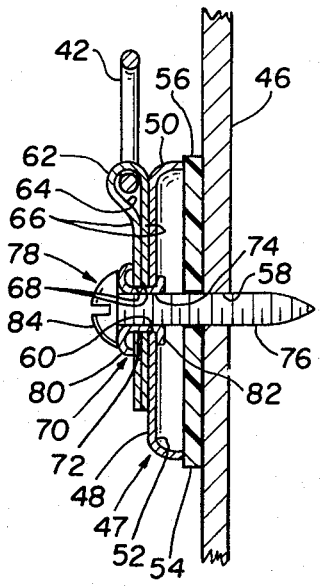
FIG.12

GUITAR STRAP

The present invention relates generally to improvements for an attached supporting strap for a guitar or similar musical instrument, and more particularly to improvements for completing the guitar and strap attachment firmly, but without impeding the swiveling relation therebetween as is necessary for adjusting the position of the instrument during the playing thereof.

During playing of a guitar, it is customary for the instrument to be supported by a strap looped over one shoulder and attached at one end to a bottom central location on the guitar body and at an opposite end adjacent the end of the guitar neck or bridge. Heretofore, the attachment of the strap end to the guitar body wall has been particularly vulnerable to failure and inadvertent disengagement due probably to the need to satisfy the performance requirements of the guitar body wall as a musical instrument, which requirements are not necessarily consistent with achieving a firm attachment. In fact, to provide a resonant body having good musical qualities the guitar body wall is typically thin and of a weak construction material, and being so constituted is a structural component to which it is difficult to achieve any firm attachment. Further complicating the problem are the forces that result from strumming the instrument and thus unavoidably strain the attachment, as well as the vibrations that are induced in the instrument body and also have a tendency to dislodge or disengage any component attached thereto.

Broadly, it is an object of the present invention to provide an improved guitar-attached support strap overcoming the foregoing and other shortcomings of the prior art. Specifically, it is an object to provide a firmly mounted rotation axis to the guitar, to which the support strap is readily attached and wherein the firmness of the mounting thereof, by preventing any movement in the rotation axis, effectively prevents it from working loose of the guitar body wall, despite the thinness and weak construction material of the wall.

A guitar strap attached in swiveling relation to a guitar body demonstrating objects and advantages of the present invention includes an attachment member having a central operative surface maintained at a clearance position from the guitar body by a peripheral lip which extends transversely from said central operative surface. A cylindrically shaped threaded screw with an enlarged diameter head is disposed through the operative surface into threaded engagement with the guitar body. Next to be included on the screw is a guitar strap loop having an operative interposed position between the screw head and the attachment member central surface. A hollow rivet disposed in encircling relation about the screw has ends on opposite sides of the components disposed on the screw appropriately flared or swaged outwardly to maintain these components in disposed relation on the screw while permitting the guitar strap loop, in particular, to swivel about the hollow rivet, the one flared end of the hollow rivet being accommodated in the clearance between the attachment member and the supporting guitar body wall. As a result, threaded adjustment of the screw contributes to the firmness of the attachment of the guitar strap loop to the guitar body, but without adverse effect on the swiveling movement thereof.

The above brief description, as well as further objects, features and advantages of the present invention, will be more fully appreciated by reference to the following detailed description of a presently preferred, but nontheless illustrative embodiment in accordance with the present invention, when taken in conjunction with the accompanying drawings, wherein:

FIG. 1 is a perspective view illustrating a prior art guitar strap in attached relation to a guitar, the latter being shown in phantom perspective;

FIG. 2 is an isolated perspective view of the guitar strap showing details of the prior art manner in which it is attached to the guitar; and FIG. 3 is a side elevational view, on an enlarged scale, illustrating a capstan which is attached to the guitar and is, according to prior art practice, the structural unit to which an end of the guitar strap is attached.

Figure 1:
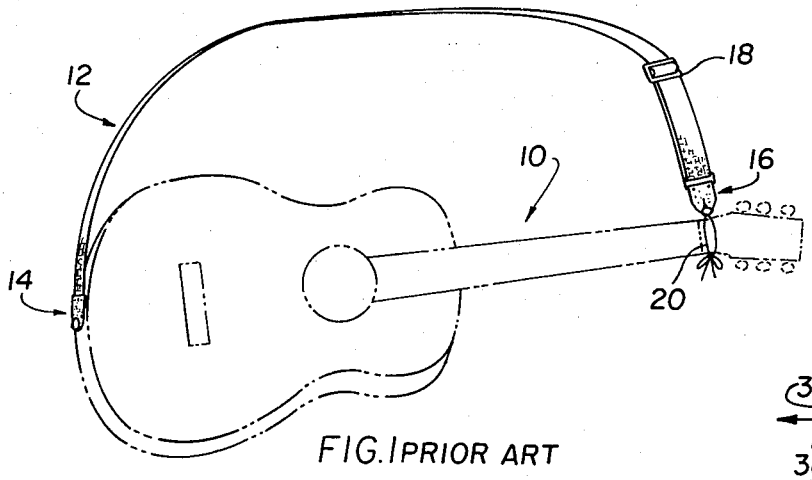
FIG. 1 PRIOR ART
FIGS. 1, 2 and 3 illustrate the closest known prior art. More particularly.
Figure 4:
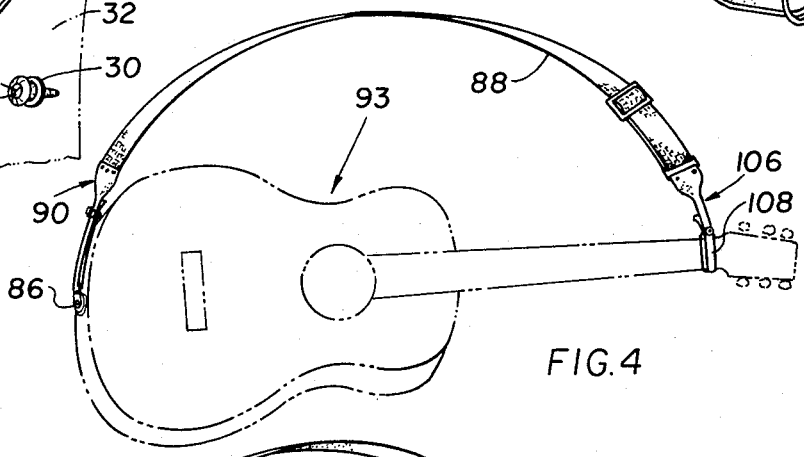
Figure 5:
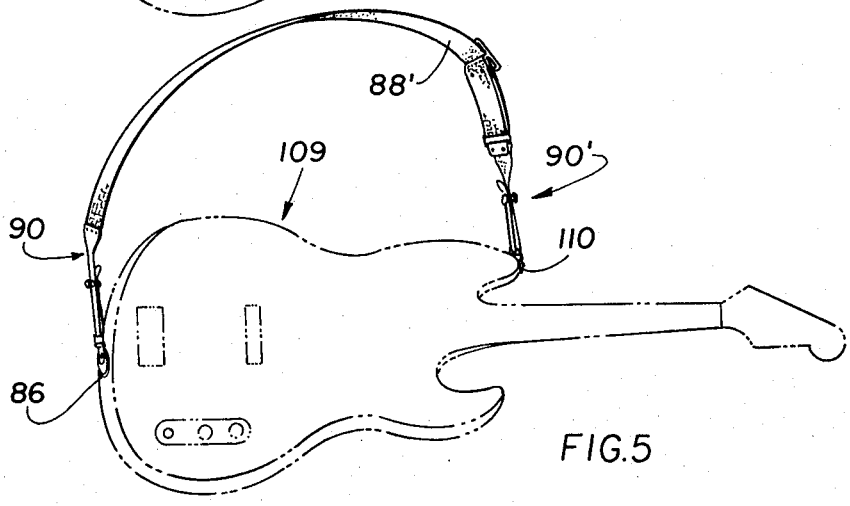

Remaining FIGS. 4–12, inclusive, illustrate the within improvements for attaching a supporting strap to a guitar or the like. More particularly, FIG. 4, like FIG. 1, is a perspective view of a guitar strap in attached relation to a guitar, the latter being shown in phantom perspective;

FIG. 5 is a perspective view similar to FIG. 4 illustrating the strap attached to an electric guitar and, as such, having both ends of the strap similarly attached to the guitar using the within inventive improvements;

FIG. 6 is an isolated perspective view of the guitar strap in which structural details of the opposite ends thereof are specifically illustrated;

FIG. 7 is a partial side elevational view of one end of the strap as seen in the direction of the line 7—7 of FIG. 6;

FIG. 8 is a similar partial view of said same end of the strap but in plan, and as seen along line 8—8 of FIG. 7;

FIG. 9 is a partial side elevational view of the other end of the strap, and as seen in the direction of the line 9—9 of FIG. 6;

FIG. 10 is a partial plan view of the end of the strap as seen along line 10—10 of FIG. 10;

FIG. 11 is a perspective view, on an enlarged scale, showing in disassembled perspective the individual components utilized in attaching an end of the support strap in swiveling relation to the guitar; and FIG. 12 is a side elevational view of the components of FIG. 11 illustrated in assembled and attached condition to the guitar body.

Figure 3:
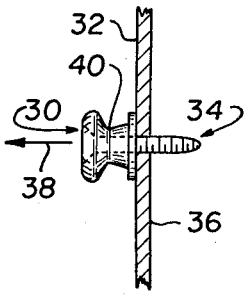
FIG. 3 PRIOR ART
Figure 2:
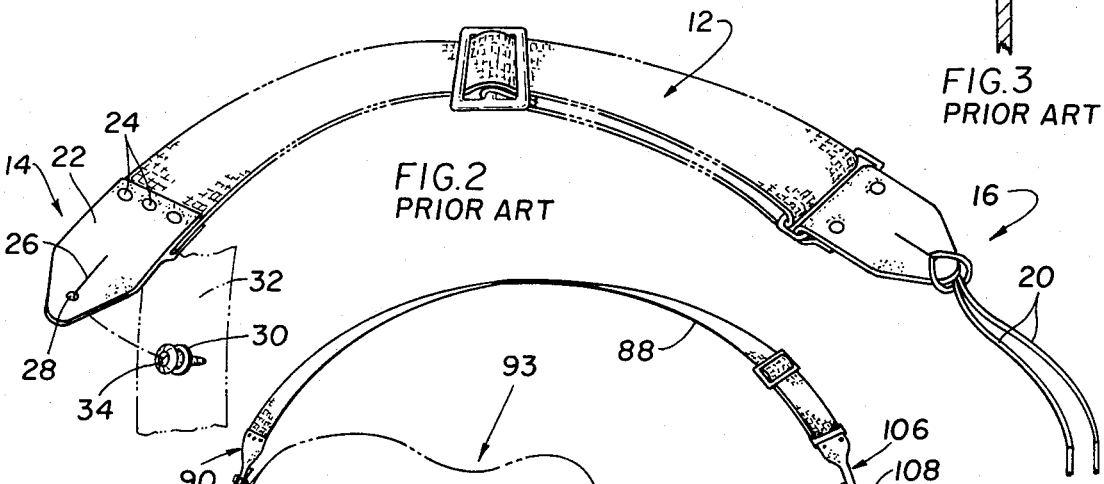
FIG. 2 PRIOR ART

Before describing the within inventive improvements for a guitar strap it is helpful, for comparison purposes, to refer to the prevalent prior art technique of attaching a support strap to a guitar, as shown in FIGS. 1–3. More particularly, and referring to said figures, a guitar 10 or a similar musical instrument is typically played while supported by a strap, generally designated 12, disposed over the shoulder of the musician and attached at opposite ends, 14, 16, to the body and bridge, respectively, of the guitar 10. The loop of the strap 12 is of course adjustable using buckle 18.

As understood, for a conventional or non-electric guitar, support strap end 16 is attached to the end of the bridge, which is the location illustration in FIG. 1, using laces 20. At the other strap end 14, however, strap 12 has a leather piece 22 appropriately attached, as by rivets 24, extending therefrom in which there is a longitudinal slit 26 terminating in a small diameter opening 28 for receiving, in projected relation therethrough, a stationary capstan 30 attached to the guitar body wall 32, at the location illustrated in FIG. 1, with a wood screw 34. Since the wall 32 bounds the internal sound chamber 36 for the guitar, and in other respects is designed more for musical qualities rather than for its mechanical attributes, the wall 32, i.e. its thickness and materials of construction have not heretofore been ideal insofar as providing a firm mounting or attaching surface for the capstan 30. In this respect, in fact, it is believed that capstan 30 is used as an attachment for the strap end 14 in order to provide some swivel or pivotally traversing movement in the strap end 14, while minimizing the exertion of any force having a tendency to pull capstan 30 free of the wall 32, particularly any force that might be applied in the direction 38.

While the edges bounding the slit 26 when seated behind the head of the capstan 30, as at the location 40, will allow for swiveling or pivotally traversing movement in the attached end 14 of the strap 12, and thus a degree of movement which readily permits adjustment in the end of the guitar which may be necessary for comfort in playing the instrument, it has been found that as a result of frequency placement of the guitar strap end 14 onto the capstan 30 and its removal therefrom, that the slit 26 becomes unduly enlarged in size and that this in turn eventually results in inadvertent disengagement of the strap end 14 from the capstan 30.

Despite the relative thinness and weak construction material of the guitar body wall, attachment is made between such wall and supporting strap, as more particularly illustrated in FIGS. 6–12, in a way which obviates prior art shortcomings as well as providing noteworthy benefits. More particularly, and referring to FIGS. 6–12, inclusive, as well as to FIGS. 11,12, it is proposed that at least one and possibly both ends of the support strap for the guitar be attached by being looped through a metal loop 42, rather than being attached by having a slit 26 fitted on a capstan 30 or the like. In making this substitution, however, it is necessary of course that loop 42 be attached in swiveling relation, or with a degree of pivotally traversing movement, about a perpendicularly oriented axis 44 of the guitar body supporting wall 46. To this end, one of the attaching components is a member generally designated 47 having a central operative surface 48 maintained at a clearance position from the wall 46 by a peripheral lip 50 extending transversely of surface 48. Thus, surface 48 and lip 50 cooperate to provide clearance or a compartment 52 on the side of surface 48 in facing relation to the support wall 46, the significance of which will soon be apparent.

Disposed in an interposed position between the circular edge 54 of the lip 50 and wall 46 is a plastic disk 56 of sufficient size to extend beneath the edge 54. Both disk 56 and the surface 48 of member 47 have central openings 58 and 60 which, when the components are assembled, are placed in aigned relation with each other.

Another component of the within strap attaching means is a loop-retaining member 62 which in its preferred form is a thin gauge metal strip which is bent at a medial location, as at 64, about a leg of the strap loop 42 so as to confine the loop 42 in place. The two bent portions of the strip 62, designated 66, like member 47 and disk 56 have aligned central openings 68.

Another significant component is a hollow rivet, generally designated 70. Rivet 70 has a cylindrical body 72 which bounds a correspondingly cylindrical open ended passage 74 through which, as illustrated in FIG. 12, a threaded body 76 of a wood screw, generally designated 78, is projected when completing the assembly of the within inventive strap attaching means. More particularly, and still referring to FIG. 12, in the assembly of the loop retaining member 62 with the operative member 47, the respective central openings 68 and 74 of these two components are aligned and the hollow rivet 74 is then projected through these aligned openings, and then one end 80 of the rivet body 72 is flared outwardly, as illustrated, to contribute to retaining the components 62 and 46 in place in encirculing relation about the rivet 70. The mounting of the components 72 and 46 on rivet 70 is completed by the flaring outwardly of the opposite rivet end 82 on the other end of the assembly. In this regard, it should be noted that the room for the outwardly flared or swaged retaining lip or end 82 of rivet 70 is provided by the clearance of chamber 52 that is embodied in the construction of member 47.

With the completion of the sub-assembly of the component 62 and member 48 using the hollow rivet 70, the wood screw 78 with its enlarged diameter head 84 is then projected through the axial opening or passage 74 of rivet 70. Next, the plastic disk 56 is placed over the projecting threaded body 76 of the wood screw 78 using, of course, the disk central opening 58. Wood screw 78 is then threadably engaged to the guitar wall body 46 at a selected location which is typically at a bottom central location of the guitar body, as at the location 86 as illustrated in FIG. 4.

Still referring to FIG. 4, it will be noted that following the attachment of the FIG. 11 components in the manner as just described in connection with FIG. 12, that a guitar support strap 88 and, more particularly, end 90 thereof, is readily looped through the metal loop 42 of the attaching structure. To this end, and as is most clearly illustrated in FIGS. 7 and 8, strap end 90 is comprised as a comparatively thin elongated strip 92 with centrally located spaced openings individually and collectively designated 94 therein. Depending on what size loop is desired to be made of the strip 92, the user will align an appropriate cooperating pair of openings 94 with each other and then insert in these openings a threadably engageable plastic bolt 96 and nut 98.

Still referring to FIGS. 7, 8, it will be noted that to contribute to the ease of achieving adjusting movement of the strap end 90, that at its upper or wider portion 100, that the same is looped through a link or loop 102 and fastened by rivets 104. Link 102 is, of course, also appropriately attached to the guitar strap 88.

Returning to FIG. 4, since guitar 93 is of the non-electric type, the opposite end of strap 88, namely end 106, is loop about the neck or bridge of the guitar, as illustrated not only in FIG. 4 but also in more detail in FIGS. 9 and 10, and the strip 109 used for this connection again secured into a closed loop using a plastic bolt 96 and nut 98.

In the embodiment utilizing the within inventive improvements as illustrated in FIG. 5, the only difference is that the illustrated guitar is of the electric type, and that in accordance with custom with this type of guitar both ends of the guitar strap 88' are similarly attached thereto using the components of FIG. 11 in their assembled condition as illustrated in FIG. 12. That is, and as illustrated in FIG. 5, strap end 90 is attached at location 86 and the other strap end, constructed similar to end 90 and therefore designated by this reference numeral primed, is attached, not to the bridge or neck, but at body location 110.

From the foregoing, it should be readily appreciated that there has been described herein structural components, as more particularly illustrated in FIGS. 11, 12, which cooperate in providing a firm attachment of a supporting strap end to the guitar without adversely interfering with swiveling or pivotally traversing movement in the attached strap end. As already noted, although the thickness of the construction material of a typical guitar body wall, such as wall 46, is difficult to make a firm attachment to, and is vulnerable to having anything attached to it being inadvertently detached, particularly in a normal direction (such as direction 38 in FIG. 3), such shortcomings are obviated using the within inventive strap-attaching components as described herein. It is believed that this in part may be the result of force which concentrates along the peripheral edge 54 of member 47 and is applied about the peripheral edge of the plastic disk 56 in response to the engagement between the wood screw threads 76 and the wall 46. Also, the engagement of the wood screw shank 76 with the wall 46, together with engagement of member 47 at its peripheral edge 52, is believed to effectively hold the wood screw shank 76 in a perpendicular orientation to the wall 46 and thus correspondingly effectively enables it to function as a rotation axis for the strap-engaging loop 42 and its retaining member 62. This, of course, contributes to effective swiveling or rotatable traversing movement in the strap loop 42, and thus in the strap end attached thereto.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A guitar strap loop attached in swiveling relation to a guitar body comprising an attachment member having a central operative surface maintained at a clearance position from said guitar body by a peripheral lip extending transversely from said central operative surface into contact with said guitar body, a cylindrically shaped threaded screw with an enlarged diameter head disposed through said operative surface into threaded engagement with said guitar body, a guitar strap loop disposed on said screw having an operative interposed position between said head of said screw and said attachment member central surface, a hollow rivet disposed in encircling relation about said screw having an outwardly flared pair of ends adjacent said screw head and in said clearance beneath said attachment member central surface for maintaining said guitar strap loop in disposed relation on said screw while permitting said guitar strap loop to swivel about said hollow rivet, and a plastic disk disposed on said screw positioned adjacent said guitar body and sized to extend beneath said attachment member peripheral lip, whereby threaded adjustment of said screw contributes to the firmness of the attachment of said guitar strap loop to said guitar body without adverse effect on the swiveling movement thereof.

2. The guitar strap loop attached to a guitar as claimed in claim 1 wherein said attachment member is of a metal construction material so as to present said peripheral lip thereon as a comparatively thin edge, to thereby contribute to the application of an attaching force which is concentrated along said thin edge.

3. A cooperating pair of guitar strap loops attached at two locations to a guitar as claimed in claim 2, wherein opposite ends of a guitar strap are adapted to be disposed in looped attachment thereto for supporting said guitar.

* * * * *